US009746286B2

(12) United States Patent
Piepmeyer et al.

(10) Patent No.: US 9,746,286 B2
(45) Date of Patent: Aug. 29, 2017

(54) SYSTEM AND METHOD FOR TARGET ENGAGEMENT

(71) Applicants: William J. Piepmeyer, Fisherville, KY (US); Joshua Strickland, Elizabethtown, KY (US)

(72) Inventors: William J. Piepmeyer, Fisherville, KY (US); Joshua Strickland, Elizabethtown, KY (US)

( * ) Notice: Subject to any disclaimer, the term of this patent is extended or adjusted under 35 U.S.C. 154(b) by 0 days.

(21) Appl. No.: 15/178,547

(22) Filed: Jun. 9, 2016

(65) Prior Publication Data

US 2017/0067719 A1 Mar. 9, 2017

Related U.S. Application Data

(60) Provisional application No. 62/172,837, filed on Jun. 9, 2015.

(51) Int. Cl.

| | |
|---|---|
| ***F41A 9/53*** | (2006.01) |
| ***F41G 1/473*** | (2006.01) |
| ***F41G 11/00*** | (2006.01) |
| ***F41G 3/14*** | (2006.01) |
| ***F41G 3/16*** | (2006.01) |

(52) U.S. Cl.

CPC ..... *F41G 1/473* (2013.01); *F41G 3/142* (2013.01); *F41G 3/165* (2013.01); *F41G 11/003* (2013.01)

(58) Field of Classification Search

CPC ..... F41G 1/473; F41G 3/142; F41G 3/165; F41G 11/003

USPC ..... 42/1.01, 105, 114; 89/41.17, 41.05

See application file for complete search history.

(56) References Cited

U.S. PATENT DOCUMENTS

| | | | | |
|---|---|---|---|---|
| 5,824,942 | A | 10/1998 | Mladjan et al. | |
| 6,499,382 | B1 | 12/2002 | Lougheed et al. | |
| 6,568,118 | B1 | 5/2003 | Teetzel | |
| 6,594,937 | B2 | 7/2003 | Weichert et al. | |
| 7,225,578 | B2 | 6/2007 | Tai | |
| 7,296,358 | B1 | 11/2007 | Murphy et al. | |
| 7,797,873 | B2 | 9/2010 | Gering et al. | |
| 7,966,763 | B1 | 6/2011 | Schneider et al. | |
| 8,047,118 | B1 * | 11/2011 | Teetzel | F41G 1/473 235/414 |
| 8,100,044 | B1 * | 1/2012 | Teetzel | F41G 1/473 235/414 |
| 8,561,518 | B2 | 10/2013 | Teetzel et al. | |
| 8,756,852 | B2 | 6/2014 | Kramer et al. | |
| 8,757,487 | B2 | 6/2014 | Santini et al. | |

(Continued)

*Primary Examiner* — Samir Abdosh

(74) *Attorney, Agent, or Firm* — Brian W. Foxworthy; Robert R. Waters; Waters Law Group, PLLC

(57) ABSTRACT

Embodiments of the present invention assist in aiming indirect fire weapons and firearms. A housing having a display and containing electronics attaches to a firearm. The electronics contain performance information specific to at least one firearm and munitions used in that firearm. Selector switches allow an operator to select the correct firearm and round to be fired from the firearm. Then, as an initial step in aiming, the operator directs the end of the weapon at a target. Then the operator adjusts the position of the firearm while observing the display. The electronics monitor the relative orientation of the firearm and displays feedback on the display as the orientation of the firearm is changed by an operator. When the display indicates the firearm is correctly aimed, the operator discharges the firearm.

8 Claims, 5 Drawing Sheets

(56) References Cited

U.S. PATENT DOCUMENTS

| | | | | |
|---|---|---|---|---|
| 9,062,961 | B2 * | 6/2015 | Chen | G01B 11/00 |
| 9,310,163 | B2 | 4/2016 | Bay | |
| 9,506,723 | B2 * | 11/2016 | Teetzel | F41G 1/35 |
| 2012/0043381 | A1 * | 2/2012 | Teetzel | F41G 1/473 235/404 |
| 2015/0106046 | A1 * | 4/2015 | Chen | G01B 11/00 702/94 |
| 2016/0010949 | A1 * | 1/2016 | Teetzel | F41G 1/35 42/115 |

* cited by examiner

SYSTEM AND METHOD FOR TARGET ENGAGEMENT

CROSS REFERENCE TO RELATED APPLICATIONS

This application claims priority to U.S. Provisional Application 62/172,837 filed on Jun. 9, 2015. The entirety of U.S. Provisional Application 62/172,837 including both the figures and specification are incorporated herein by reference.

FIELD OF THE INVENTION

The present application is generally related to improving the accuracy of targeting. More specifically, the present application is related to improving the accuracy of targeting for high angle trajectories.

BACKGROUND OF THE INVENTION

A problem long-faced by those who provide and use prior art systems and methods of target engagement has been an inability before now to ensure first-round hits when firing projectiles having a parabolic trajectory when in flight. While true for high velocity projectiles such as, for example, rifle bullets, the problem is even more exacerbated when firing lower velocity projectiles that are large and heavy, such as, for example, grenades.

Dating back to the 1960's, the M79 Grenade Launcher provided an individual operator with the ability to fire explosive casualty-producing grenades at targets at distances of up to several hundred yards away. This weapon was fielded as a break-open, breech-loaded, single-shot device with a basic leaf sight affixed to it. The leaf sight would flip up to enable a user to align the front sight post thereto. By selectively aligning the front sight post to one of several provided range markings bordering the rear leaf and corresponding to the user's range estimation to the target, the user could roughly aim the weapon at the target. To users, the M79 appeared to be much like a single-shot break-open shotgun in appearance and function. Even experienced gunners found that first-round hits close enough to achieve effect on target were not guaranteed.

Once the M16 rifle (and its many subsequent variants to include the M16A2) was fielded, designers then provided a grenade-firing system that could be attached to an M16; thus the M203 was introduced. An M203 operator was provided a choice of two different sighting systems: a leaf sight similar to that of the M79, and a quadrant sight. With reference to FIG. 1 PRIOR ART, an illustrative example provides nomenclature of a traditional quadrant sight 91 for the M203 affixed to the upper receiver of an M16 with mounting screw 92 and clamp. While the M203 quadrant sight assembly is currently obsolete and most military organizations using the M203, no longer issue, or train in the use of, the quadrant sight assembly, a brief review of its function in the prior art will help in understanding the teachings of the current embodiments and alternatives.

With continued reference to FIG. 1 PRIOR ART, the quadrant sight assembly 91 is affixed to the left side of the M16 rifle's carrying handle 90 with the intent of allowing a grenadier to adjust the sights for elevation and windage by means of sliding and rotating various elements that flip out from being stowed in a folded flat position alongside the rifle. Sight arm 93 mounts both rear sight aperture arm 94 (which holds rear sight aperture 95) and sight post arm 96 (which holds the front sight post 97). Range quadrant 98 is graduated in 25-meter increments from 50 to 400 meters. Applying rearward pressure on the sight latch 99 releases quadrant sight arm 93 so it can move along range quadrant 98. Centering a number in rear sight aperture 95 selects the desired range. Releasing sight latch 99 locks the quadrant sight 91 in position. With quadrant sight 91 adjusted to the desired range, it can be used to aim a grenade launcher such as the M203.

Although perhaps seen as an improvement over the earlier leaf sight, the grenadier encountered numerous problems when using the quadrant sight assembly 91. Not only was it bulky in design, the quadrant sight assembly 91 was also not durable. In fact, if any single element was broken off or missing, the entire sight was rendered inoperable. As such, the quadrant sight became unusable if any material change to the structure of the assembly occurred. Unfortunately, such was often the case when the quadrant sight was taken into combat and other high-stress situations.

More recently, the M16A2 has been replaced with the M4 Carbine. While the M16 could at least mount a quadrant sight by virtue of its carrying handle (see FIG. 1 PRIOR ART), the M4 does NOT have a carrying handle. Therefore, it is no longer possible to affix a quadrant sight to such weapons. Instead of the carrying handle, an additional feature often found on such weapons is a Picatinny Rail to which various auxiliary systems may be optionally mounted. A Picatinny Rail may be seen in FIGS. 2-4. For example, the M4 Carbine accepts a rail-mounted primary weapon optical sight. While such a sight, an advanced combat optical gunsight (ACOG) for example, may be useful for well-aimed rifle fire, an unmet need today is that here is currently no sight of any kind available for the M203 and the grenades it fires. The Army today trains its soldiers to utilize the front sight post of their M4 weapon system and to walk-in rounds as they engage their targets. This technique takes much longer to hit the enemy as it requires multiple shots before achieving a hit on target, thereby increasing the time for and accuracy of return fire from an enemy against the grenadier. In addition, walking in rounds requires additional training and additional cost for range time and ammunition.

As an answer to long-faced problems in the art, the present embodiments and alternatives provide a System and Method for Target Engagement that solves the problem of providing a sight for the M203 that profoundly increases the capability of operators to reliably achieve first-round hits when engaging targets. Embodiments of the invention of the present application makes the M203, and other potential weapons, much more user friendly and effective.

RELEVANT ART

U.S. Pat. No. 7,296,358 B1 by Murphy, et al. is for a "Digital vertical level indicator for improving the aim of projectile launching devices". An electronic vertical angle sensing and indicating device for use on aiming systems is provided for bow sights and for other aiming sights for projectile launchers. Improved vertical level measurement and display minimizes the left-right drift of a projectile by sensing and indicating to the user when the projectile launcher is tilted slightly prior to release of the projectile. In Murphy, the vertical level indicator is viewed within the field of direct or near direct vision, so the operator is not distracted from the task of accurately aiming the projectile. One embodiment of Murphy positions the signal indicators in the far-field of view of the eye, so that all of the signal indicators, the sighting means and the distant target being viewed are simultaneously in focus or near-focus.

U.S. Pat. No. 8,757,487 B2 by Santini, et al. is for an "Optoelectronic digital apparatus for assisting an operator in determining the shooting attitude to be given to a hand-held grenade launcher so as to strike a moving target, and respective operation method". Santini, et al, disclose an embodiment of an optoelectronic apparatus for assisting an operator in determining the shooting attitude to give to a hand-held grenade launcher so as to strike a moving target. Santini, et al. includes an electronic processing unit configured so as to: measure the pitch angle and the heading angle of the grenade launcher and the distance of the target when the grenade launcher is moved by the operator during the pointing of the moving target; determine position data indicative of the positions of the moving target; determine a future impact time of the grenade on the target on the basis of position data and of data indicative of the ballistics of the grenade, determine a shooting attitude of the target on the basis of the impact time; measure the pitch angle and heading angle indicating the attitude imparted to the grenade launcher by the operator; compute a pitch difference between the shooting pitch angle and the pitch angle measured and a heading difference between the shooting heading angle and the heading angle measured; and, communicate to the operator the variation of pitch and/or heading to be given to the grenade launcher so that the pitch and/or heading difference is zero.

U.S. Pat. No. 7,797,873 B2 by Gering, et al. is for an "Sighting system for a fire arm". Gering, et al. discloses an improved sighting system for a firearm, characterized in that it comprises a single indicator light; a sighting device providing an alignment opening with a longitudinal reference plane (X-X') which is parallel or mainly parallel to the axis (Y-Y') of the barrel and which is aligned with the indicator light; an inclinometer to measure the elevation angle (A) of the fire arm; a ballistic calculator connected to the indicator light and to the inclinometer, making it possible to calculate the desired angle of inclination of the fire arm as a function of the distance of the target and to control the indicator light so as to signal at what moment the measured elevation angle (A) corresponds to the calculated elevation angle.

SUMMARY OF EMBODIMENTS OF THE INVENTION

Embodiments of the present invention assist in aiming indirect fire weapons and firearms. A housing having a display and containing electronics attaches to a firearm. The electronics contain performance information specific to at least one firearm and munitions used in that firearm. Selector switches allow an operator to select the correct firearm and round to be fired from the firearm. Then, as an initial step in aiming, the operator directs the end of the weapon at a target. Then the operator adjusts the position of the firearm while observing the display. The electronics monitor the relative orientation of the firearm and displays feedback on the display as the orientation of the firearm is changed by an operator. When the display indicates the firearm is correctly aimed, the operator discharges the firearm.

Information that may be displayed include: the cant of the firearm; the calculated distance the projection will travel based on the current elevation of the firearm; and, information about previous shots. Presenting the elevation information in terms of distance means the information presented is specific to that firearm. Presenting information on previous shots allows an operator to more accurately adjust subsequent shots.

BRIEF DESCRIPTION OF DRAWINGS

Additional utility and features of the invention will become more fully apparent to those skilled in the art by reference to the following drawings, which illustrate some of the primary features of preferred embodiments.

DETAILED DESCRIPTION OF EMBODIMENTS OF THE INVENTION

With reference to FIGS. 2-6, a system for target engagement 10 is provided. As further details and examples will show, the system 10 allows users to rapidly engage targets without having to move the weapon system to the firing eye and also without having to first zero the device.

Figure 1:
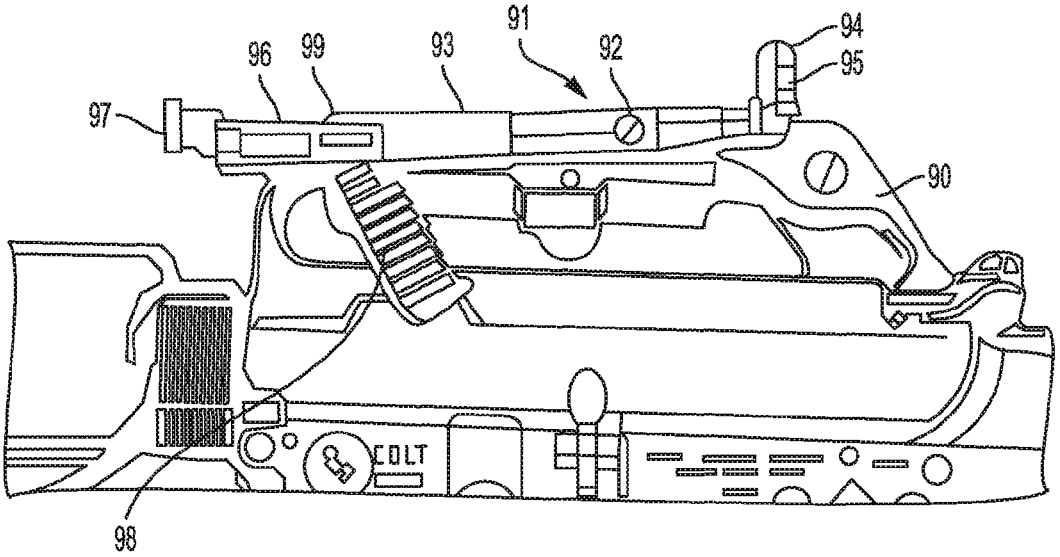
FIG. 1 PRIOR ART
FIG. 1 is a left-side view illustrating a PRIOR ART traditional M203 quadrant sight.
Figure 2:
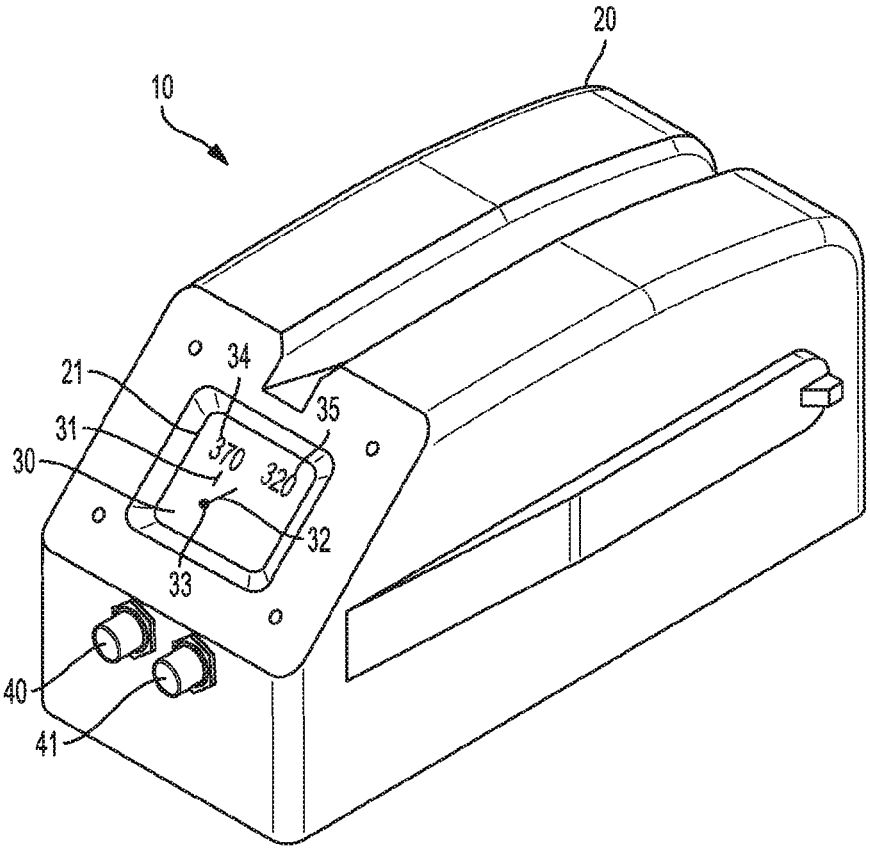
FIG. 2 is a perspective view of an embodiment of a firearm aiming device of the current application shown from the display end of the device.

FIG. 2 is a perspective view of an embodiment of a firearm aiming device, or system, 10 of the current application shown from the display end of the device. Firearm aiming device 10 comprises an outer case 20 which houses electronics, including display 30 and selectors 40 and 41. Display 30 and selectors 40 and 41 are in electrical continuity with electronics within outer case, or housing, 20. Case 20 has an aperture 21 in which display 30 is mounted.

Figure 3:
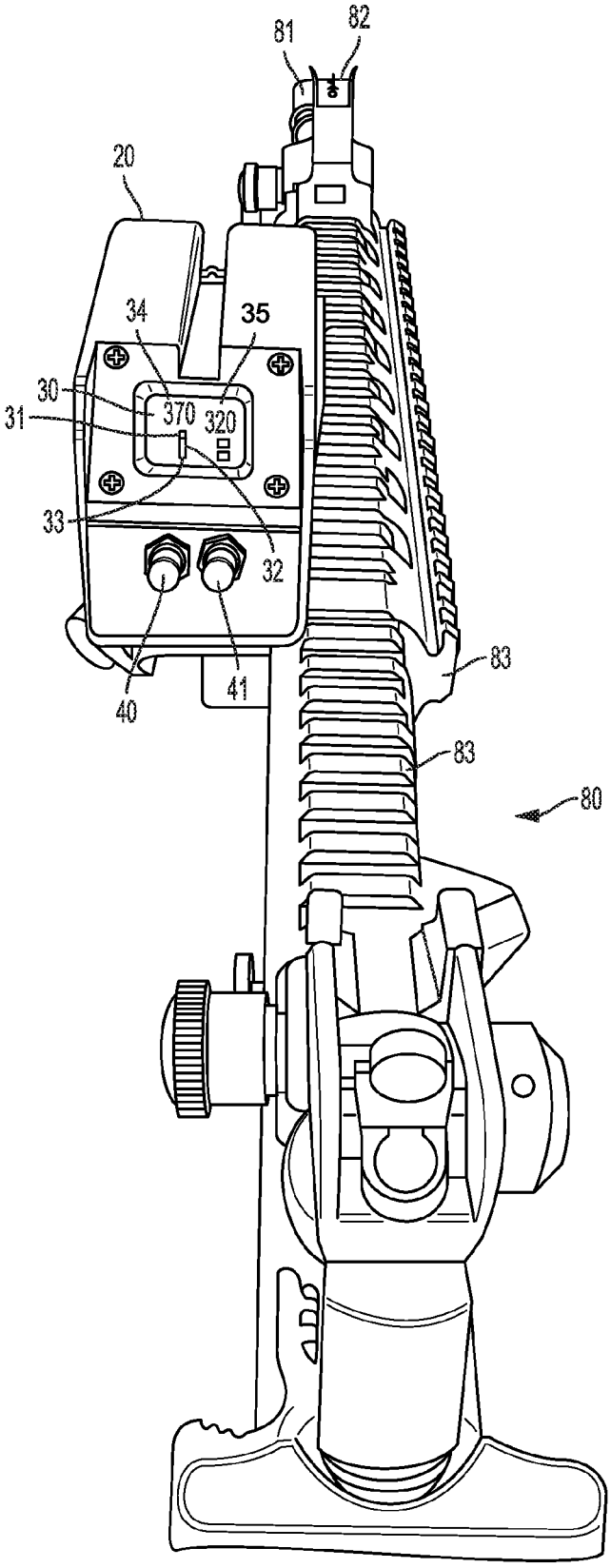
FIG. 3 is a perspective view of an embodiment of the firearm aiming device of FIG. 2 attached to a firearm.
Figure 4:
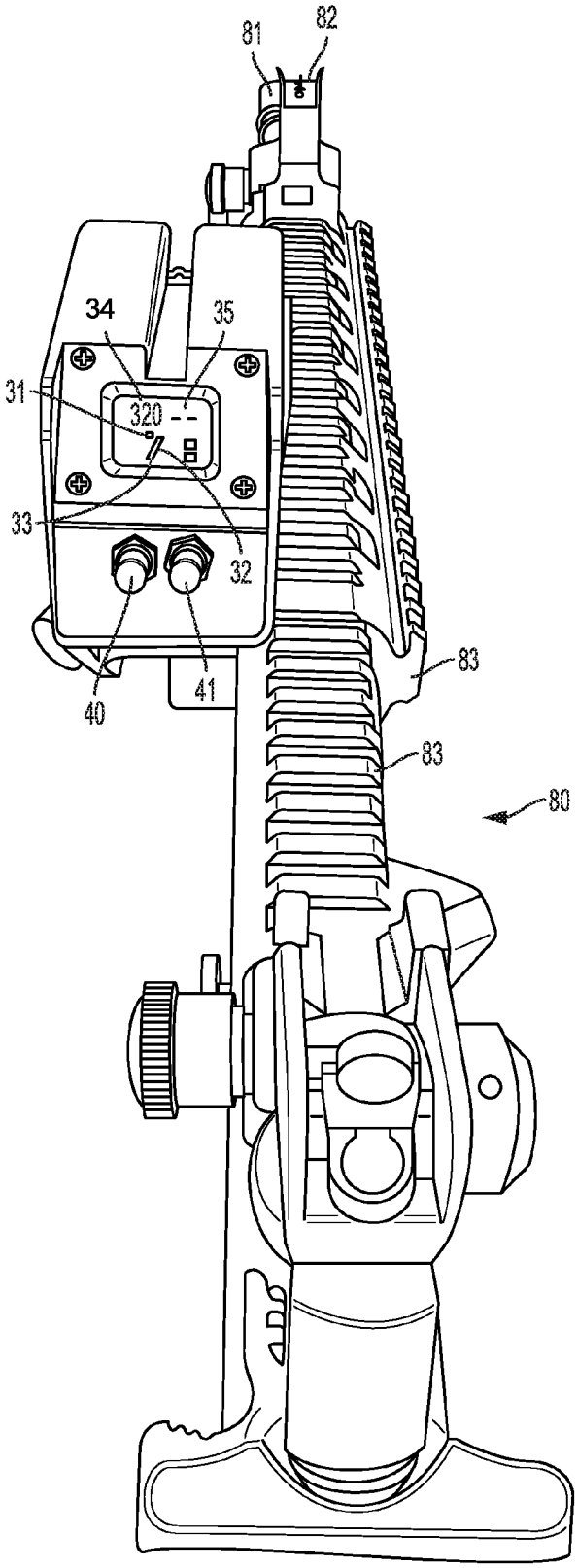
FIG. 4 is a perspective view of an embodiment of the firearm aiming device of FIG. 2 attached to a firearm with different information shown in display.

Referring to FIGS. 3 and 4, aiming device 10 is attached to a firearm in such a position that display 30 is visible to the firearm operator when the operator is actively using the firearm. As an initial step in aiming firearm 80, the operator directs barrel 81, or barrel sight 82, of firearm 80 at the target. In situations where the firearm being aimed is actually a grenade launcher attached beneath a main long arm, it is implicit that the two are sufficiently aligned that directing the barrel 81, or barrel sight 82, of the main long arm toward a target is also effective for aiming the attached firearm. The initial step of directing barrel 81, or barrel sight 82, toward a target controls a first position variable of direction for the firearm. Two other position variables of the firearm must be controlled by the user.

A second variable a user must control is the tilt of the weapon in a left-right sense with respect to the user. This tilt is referred to as the cant of the weapon and measures the alignment of the weapon with the vertical plane common to the user and target. A third position variable that must be controlled by a user is the elevation of the firearm. The elevation of the firearm is the angle it forms with the ground. The elevation of the firearm combines with the velocity and other characteristics particular to a projectile to determine the parabolic, or ballistic, trajectory of the projectile being fired. The trajectory determines the linear distance the projectile will travel before returning to ground. Matching the linear distance traveled by a projectile with the linear distance to the target leads to accurate placement of a projectile, or round.

Display 30 is visible in FIGS. 2-4. Display 30 visually transmits several pieces of information as real time feedback for the user controlled variables of cant and elevation that determine the trajectory of a projectile and its accuracy to target. In the embodiments shown, display 30 provides symbolic feedback regarding cant and numerical feedback regarding elevation.

To communicate the cant of the firearm, display 30 presents at least two line segments. In the display of the figures, a first line segment 31 is positioned more or less above a second line segment 32. The lines containing first and second line segments, 31, 32, intersect toward the bottom of display 30 at a projected intersection point 33 toward the bottom of display 30. First line segment 31 maintains a fixed "up and down" alignment in display 30 and, being fixed in display 30, moves in concert with firearm 80, giving an indication of the orientation, tilt, or cant, of firearm 80. Second line segment 32 in display 30 rotates in display 30 about the projected intersection point 33 of line segments 31 and 32. The orientation of second line segment 32 is controlled by the electronics in housing 20 which sense the vertical and orients second line segment 32 accordingly. As the left-right tilt of firearm 80 is adjusted, first line segment 31, representing firearm 80, is brought into alignment with second line segment 32, representing vertical. When first line segment 31 is aligned with second line segment 32, the cant of firearm 80 is reduced to zero, ensuring that firearm 80 is aligned with the vertical plane common to the operator and the target.

In FIGS. 2-4, display 30 provides numerical feedback regarding the angle of elevation of firearm 80. This numerical feedback is a distance indicator 34 and is in terms, or units, of distance the projectile will travel if the firearm is fired at its present angle of elevation. Thus, an operator only needs to decide the distance to target and observe the distance indicator as the elevation of firearm 80 is adjusted. When distance indicator 34 matches the desired distance, the firearm is in position to be fired for an accurately placed round, or projectile. The operator does not need to specifically consider the angle of elevation. Rather, the electronics of firearm aiming device 10 calculate the resulting distance for a given elevation of firearm 80 based on known data for a given firearm and a given munition. The operator only needs to determined the desired distance.

As noted above, the electronics of firearm aiming device 10 makes trajectory calculations specific to given firearms and munitions. As selected in manufacturing, a system 10 is provided for any of a range of projectile-firing weapons, as desired. For example, embodiments support a variety of known weapon systems includes the M203, Mark 19, mortar tubes, and any man-portable (or larger) weapon system for which projectiles travel in a parabolic trajectory such that ballistics and flight path are known and repeatable, thereby lending themselves to be calculated with the result stored in a firing table. Old school, prior art, weapons provided such tables in paper form as appendices to their doctrinal operating manuals. See for example, the US Marine Corps' OH 6-9 which provides such data for an MK 19 grenade machinegun.

Inherent in the system 10 is a firing table transformed from paper and graphical tables into a stored numerical lookup table (not shown) that is prepared based on known data for a ballistic profile associated with the various ordnance to be fired from the selected weapon. While the creation and provision of such tables is well known within the current art for numerical processors, processing and processes, typical information factored into the creation of a table includes variables such as, for example; muzzle velocity of a projectile in units such as Feet Per Second (FPS) or Meters Per Second (MPS), and projectile launch angle wherein said angle is referenced to a zero datum. For example, embodiments include those wherein the zero datum is referenced to a value corresponding to the user's weapon being held in a position that is level and uncanted with respect to the ground. There are predefined values and user-controlled variables, such as cant and elevation. With a table providing values for all relevant combinations of these values, a trajectory is mapped to associate the user-controlled variables, those things that the user is expected to control when firing, of weapon inclination angle and weapon cant with flight of a projectile to a specified distance from a user.

Alternative embodiments of firearm aiming system 10 allow for the user to set the system 10 with a desired range to target and alternatives provide for the system 10 to determine range to target and to include that range in a visually presented firing solution. Some embodiments further allow for weapon angle to be additionally adjusted based on a relative elevation of the user to the target; such as, for example not meant to be limiting, engaging targets on a steep uphill or a steep downhill from a user. While side hill situations are also measurable and accounted for, accuracy is more dictated by accounting for the relative elevation between the user and the target. In effect, embodiments include those which allow for angle cosine and other relative elevation targeting factors to be accounted for in the visual cues provided to user. Further embodiments of the system 10 tailored to use by persons in sports such as golf, for example, do account for side hill situations in providing visual cues not only for distance to target, but also in displaying a recommended golf club for any particular user based upon a predefined set of inputs to the table corresponding with shot distances for each club that the user carries on the course.

With further reference to an example for embodiments provided for use with a M203 grenade launcher, embodiments include low angle and high angle tabular solutions, as available based on ballistics data, to achieve a hit at a given distance. For example, for any given projectile and ballistic trajectory profile, two weapon angles may be used, either of which will result in a hit on target. At distances to target near the user it may be possible to depress the weapon and achieve a low angle point blank firing solution. At that same distance to target, the user may elect to shoot using a high angle firing solution, as foreseen in cases when a user wishes to fire indirectly over intervening obstacles on a line of sight and between the user and the target. As the distance to target increases, at some point the low and high angle firing solutions merge into being one and the same; a single firing solution. For example with respect to embodiments provided for use with grenades fired from a M203, while a grenadier may be able to engage a target 50 meters away with either of a low or high angle firing solution, if the target is 250 meters away, only a single firing solution will be available. Embodiments include those wherein the table provides range data capped at a maximum range possible for a given projectile. In some alternatives, the table is created using firing data obtained by actually firing in order to obtain the ballistic profile.

As discussed initially, some previous aiming devices mounted to carrying handles and other features of firearms. Currently, many firearms have mounting systems fixed to the firearms. These mounting systems provide profiles, such as T-shape cross sections, and features, such as notches, to facilitate mounting of accessories to the firearm. A common standardized system is the Picatinny Rail system. Picatinny rails have a T-shape cross section and uniformly spaced notches of uniform width. FIGS. 2-4 show firearm 80 with Picatinny rails 83 attached.

Figure 5:
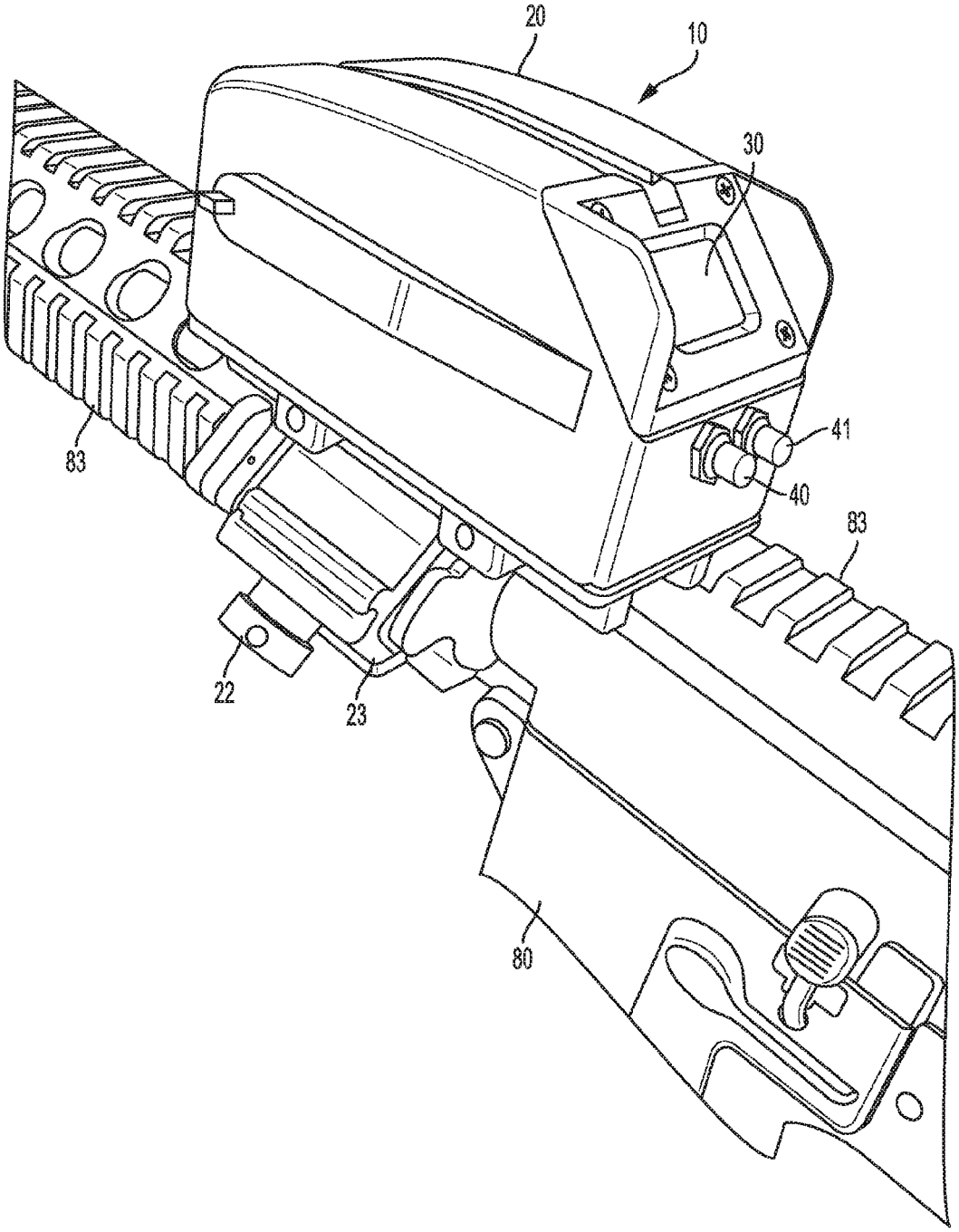
FIG. 5 is a side perspective view of a firearm aiming device of the current application attached to a firearm.

FIG. 5 is a side perspective view of firearm aiming device 10 of the current application attached to a Picatinny rail 83 on firearm 80. Knob 22 tightens clamp 23 on Picatinny rail 83 to maintain firearm aiming device 10 on firearm 80. Although the embodiments of firearm aiming device 10 shown in FIGS. 3-5 attach by clamping to a Pickatinny rail 83 on a respective firearm 80, this is not required for the device 10 to operate. Other ways of mounting device 10 to a firearm may be employed as long as the method and apparatus used is sufficiently rigid to maintain device 10 in position.

Figure 6:
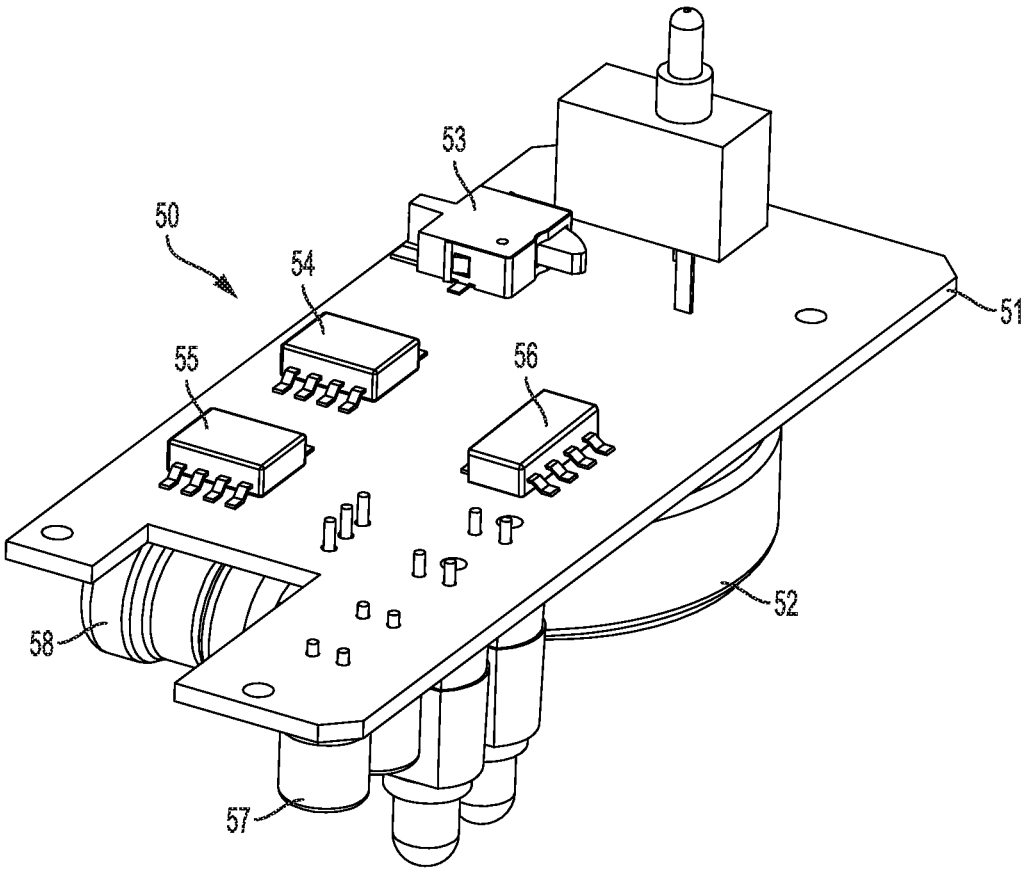
FIG. 6 is a perspective view of a sighting electronics assembly for the firearm aiming device of the current application.

FIG. 6 is a perspective view of sighting electronics assembly 50 for firearm aiming device 10 of the current application. Circuit board 51 provides the physical framework for mounting the electronic components of sighting electronics 50 as well as providing the electrical connections between the electronic components. Electronic components which may be mounted to circuit board 51 include: microprocessor 52; calibration port 53; nonvolatile memory 54; first accelerometer 55; second accelerometer 56; voltage regulator 57; and, battery 58. As stated above, display 30 and selectors 40 and 41 are in electrical continuity with sighting electronics 50.

Battery 58 supplies power to the other electronic components and voltage regulator 57 maintains steady and correct voltage for the system. Microprocessor 52 stores and executes machine readable instructions to respond to inputs from other components and operate display 30. The numerical tables and other information pertaining to specific firearms and munitions are stored in nonvolatile memory 54 accessible by microprocessor 52. Selectors 40 and 41 energize system 10 as desired and may also provide for a user to select, as desired, the model of firearm, which type of round is being fired, etc. Alternatives provide that selectors 40 and 41 may also be used to input desired range to target.

Accelerometers or other angle sensing means may be used to monitor the cant and elevation of firearm 80. In the embodiment of sighting electronics 50 shown in FIG. 6, first and second accelerometers 55 and 56 are shown. In some embodiments, only one accelerometer may be used to monitor both the cant and elevation variables. A three-axis accelerometer combining in one integrated circuit (IC) package three different accelerometers, one each for x, y, and z directions, would be well capable of monitoring both cant and elevation. In other embodiments, two accelerometers oriented at 90° to each other may be used. Microprocessor 52 monitors the accelerometer(s) and uses the information provided to determine what should be shown at display 30. Microprocessor 52 converts the angular information provided with respect to the elevation of firearm 80 to the numerical distance discussed above, based on information in non-volatile memory 54, and displays it on display 30. Both cant angle and distance are dynamically updated while sighting system 10 is being used. Although accelerometers 55 and 56 are shown in FIG. 6, other angle measuring devices such as, but not limited to, an inclinometer, a gyroscope, etc, may be used. Moreover, it is envisioned that the accelerometer, inclinometer, or the like may be of a single axis or multiple axis type, may use an internal reference for measurement, or may be configured to provide an analog or digital output.

Some embodiments of firearm aiming system 10 provide the added advantage of recording previous shots. In those embodiments, accelerometer 55 detects when a round is fired and this is communicated to microprocessor 52. Microprocessor 52 captures the elevation of firearm 80 at the moment the round is fired and also captures the corresponding distance information for the round. As an operator sees the placement of the previous round in relation to the target, this information can be used to adjust the trajectory of following rounds. Returning to FIG. 3, previous round distance 35 is displayed next to dynamically updating distance indicator 34. This allows an operator to adjust to variables in the situation such as wind, relative differences in elevation between operator and target, etc. and to quickly compensate for inadequate distance estimates. Using accelerometer 55, microprocessor 52 can also count shots and record information on multiple shots.

Embodiments of system for target engagement 10 are programmed with the correct ballistics of the weapon used in support and alternatives include those in which target engagement system 10 allows for hits as accurate as plus or minus 1 meter from where intended. By virtue of its embedded numerical lookup table, when energized by the user, system 10 instantly outputs to the display 30 selected relevant aiming data and visual cues for the user. For embodiments employing an angle sensing means, such as accelerometer 55, microprocessor 52 of system 10 transforms angle measurement data into visual cues output to display 30 thereby allowing a user to hold the weapon in a manner that eliminates weapon cant and that provides a correct weapon angle with respect to a desired distance for precise target engagement. An example, not meant to be limiting, of an angle sensing means is accelerometer 55 as shown in FIG. 6 and which measures an angle of inclination.

Embodiments of system 10 provide a negative limitation in that use requires only visual sight without a necessity for a laser system in sighting. Such embodiments have no laser systems (i.e. no laser range-finders, infrared systems, or other lighting). Additionally, the system 10 calculates aiming data without the need for: a range assisting device, a lens or an additional aim point apparatus. In addition, embodiments of the system 10 calculate aiming data and immediately illustrates same to the user by showing a numerical value for distance to the target based upon the angle of the weapon to the ground. The calculation occurs "on the fly" and is fully automatic without any pressure switches. An operator of system 10 can hold firearm 80 in a natural position and does not need to place an eye up against an eyepiece to use system 10.

Embodiments of target engagement system 10 are also unique due to their price, durability, and simplicity. System 10 is inexpensive and is a standalone unit with no moving parts. Alternative embodiments of the system 10 include a laser sight system to immediately calculate the exact distance from shooter to target. Such embodiments allow the indirect fire weapons, such as the M203, to be used with accuracies on a par with a sniper rifle because of the in-depth onboard information for a respective weapon.

A method for target engagement comprises the steps of:

1) Affix a system for target engagement 10 to a supported weapon;
2) Energize the system 10;
3) Select the weapon and type of round to be fired;

4) With reference to a display 30, hold the weapon to conform its position with visual cues provided by the display 30; and, 5) Fire the weapon.

Although embodiments of target engaging system 10 been discussed with specificity, target engaging system 10 is not limited to those specific embodiments. For example, the symbolic indication of cant was discussed with specificity. Other methods of communicating this variable could be used, such as two concentric cross hairs coming into alignment when the firearm is properly oriented, or a representation of a level bubble, etc. Additionally, the use of multiple accelerometers is discussed. However, a single multi-axis accelerometer could be used.

It will therefore be readily understood by those persons skilled in the art that the present embodiments are susceptible of a broad utility and application. While the present embodiments are described to include currently foreseeable alternatives, there may be other, unforeseeable embodiments, alternatives, and adaptations, as well as variations, modifications and equivalent arrangements that do not depart from the substance or scope of the present embodiments and alternatives. As various changes could be made in the above constructions and methods without departing from the scope of the invention, it is intended that all matter contained in the above description and shown in the accompanying drawings shall be interpreted as illustrative and not in a limiting sense. When introducing elements of the present embodiments, the articles "a", "an", "the", and "said" are intended to mean that there are one or more of the elements. The terms "comprising" "including", and "having" are intended to be inclusive and mean that there may be additional elements other than the listed elements. The foregoing disclosure is not intended or to be construed to limit or otherwise to exclude such other embodiments, alternatives, adaptations, variations, modifications and equivalent arrangements, the scope of patent protection afforded to the present embodiments being limited only by any claims and the equivalents thereof that may be sought in conjunction with the filing of a completion case for the provisional patent application filed herein.

We claim:

1. A firearm aiming device for attachment to a firearm, said aiming device comprising:

a housing, an electronic display, a microprocessor, a selector switch, an angle measuring device, and a battery;

said housing enclosing said microprocessor, selector switch, angle measuring device, and battery, and having a display aperture for said display;

said display being mounted in said display aperture and being in electrical continuity with said microprocessor;

said angle measuring device measuring the cant and elevation of the firearm;

said microprocessor storing and executing machine readable instructions, said machine readable instructions comprising ballistic trajectory information for specific firearms and related specific ammunition;

said selector switch allowing an operator to select a firearm and ammunition; wherein, said microprocessor receives information from said angle measuring device indicating cant and elevation of the firearm, converts the firearm elevation to distance for the projectile, and controls the display to symbolically show the cant of the firearm and numerically show the distance for the projectile.

2. The firearm aiming device of claim 1, wherein:

said angle measuring device is an accelerometer.

3. The firearm aiming device of claim 1, wherein:

said display symbolically shows the cant of the firearm by displaying a first line segment and a second line segment, said first line segment and second line segment directed toward a projected intersection point, said first line segment remaining fixed with respect to the firearm and said second line segment rotating as the cant of the firearm changes; wherein, alignment of said first line segment and said second line segment indicates the firearm is in a position without cant.

4. The firearm aiming device of claim 1, wherein:

said device also numerically displays the distance value for at least one previous shot.

5. The firearm aiming device of claim 1, wherein:

said device counts shots fired by the firearm.

6. The firearm aiming device of claim 1, wherein:

said device allows entry of an altitude difference between an operator and the target and said microprocessor compensates for the difference in altitude and alters the information displayed.

7. The firearm aiming device of claim 1, wherein:

the firearm has a Picatinny rail attached to it and said device attaches to the Picatinny rail on the firearm.

8. The firearm aiming device of claim 1, wherein:

said device records the performance of shots fired by a firearm and updates said ballistic trajectory information for the firearm and the specified ammunition.

* * * * *